United States Patent [19]

Stancato

[11] Patent Number: 4,941,343

[45] Date of Patent: Jul. 17, 1990

[54] METHOD AND APPARATUS FOR STRAIGHTENING VEHICLE BODIES AND FRAMES

[76] Inventor: Joe L. Stancato, 2051 Wales Ave., N.W., Massillon, Ohio 44646

[21] Appl. No.: 605,217

[22] Filed: Apr. 30, 1984

[51] Int. Cl.[5] ..... B21D 1/12

[52] U.S. Cl. ..... 72/447; 72/705

[58] Field of Search ..... 72/705, 447, 457

[56] References Cited

U.S. PATENT DOCUMENTS

| | | | |
|---|---|---|---|
| D. 216,825 | 3/1970 | Hunnicutt . | |
| 2,151,063 | 3/1939 | Weaver . | |
| 2,445,397 | 7/1948 | Horton . | |
| 2,559,250 | 7/1951 | Jackson . | |
| 3,091,278 | 5/1963 | Padgett | 72/705 |
| 3,108,629 | 10/1963 | Jenkins | 72/705 |
| 3,206,966 | 9/1965 | Fagan et al. . | |
| 3,452,575 | 7/1969 | Williams et al. . | |
| 3,526,120 | 9/1970 | Hunnicutt et al. . | |
| 3,583,203 | 6/1971 | Williams . | |
| 3,590,623 | 7/1971 | Hunnicutt et al. . | |
| 3,667,275 | 6/1972 | Hunnicutt . | |
| 3,712,108 | 1/1973 | Hunnicutt . | |
| 3,754,427 | 8/1973 | Hunnicutt et al. . | |
| 3,818,750 | 6/1974 | Ballweber | 72/705 |
| 3,869,767 | 3/1975 | Hunnicutt et al. . | |
| 4,023,394 | 5/1977 | Borup . | |
| 4,050,287 | 9/1977 | Borup . | |
| 4,055,061 | 10/1977 | Bayorgeon et al. . | |
| 4,174,623 | 11/1979 | LeGrand et al. . | |
| 4,198,847 | 4/1980 | Russell et al. . | |
| 4,215,849 | 8/1980 | Charland . | |
| 4,236,400 | 12/1980 | Specktor | 72/705 |
| 4,262,519 | 4/1981 | Mason . | |
| 4,309,894 | 1/1982 | Connor . | |
| 4,353,241 | 10/1982 | Field | 72/705 |
| 4,442,608 | 4/1984 | Clausen | 33/180 AT |
| 4,516,423 | 5/1985 | Reich | 72/705 |

FOREIGN PATENT DOCUMENTS

| | | | |
|---|---|---|---|
| 249933 | 10/1963 | Australia | 72/705 |
| 65942 | 12/1982 | European Pat. Off. | 72/705 |
| 2414325 | 10/1974 | Fed. Rep. of Germany | 72/705 |
| 2837387 | 3/1979 | Fed. Rep. of Germany | 72/705 |
| 2027623 | 2/1980 | United Kingdom | 72/705 |

*Primary Examiner*—Lowell A. Larson

*Attorney, Agent, or Firm*—Fleit, Jacobson, Cohn, Price, Holman & Stern

[57] ABSTRACT

An assembly of components and a method of using such components for straighening and repairing vehicle bodies, frames or for bending various metal components in an efficient manner. The present invention includes the use of hydraulically actuated rams to provide a force to straighten or bend metal components and a chain or similar structure to transfer the force produced by the hydraulic ram to the metal component to be straightened or bent. Unique base plates are provided for supporting one end of the hydraulic ram from a vehicle runway, platform or other stationary surface. A unique socket and stop assembly is provided for supporting the hydraulic ram from a transverse beam and also to form a stop for precluding movement of the transverse beam. A unique chain anchor is mounted on the transverse beam and anchors one end of a chain thereto thereby eliminating the necessity of providing hooks on one end of a chain and also enabling optimum vector angle of the tension force in relation to the metal component being straightened or bent. Unique stands are provided for support of crossbars extending under the vehicle which support clamps which lock the vehicle from moving while corrections are being made on the body with the stands having unique clamps for supporting them in position on the runways. A unique structure to enable pull down forces to be exerted on a vehicle component or other metal component is provided to enable vertical forces to be exerted when necessary. The unique components may be assembled quickly and efficiently in necessary positions to effectively straighten and repair vehicle bodies, frames or other metal components.

16 Claims, 6 Drawing Sheets

METHOD AND APPARATUS FOR STRAIGHTENING VEHICLE BODIES AND FRAMES

BACKGROUND OF THE INVENTION

1. Field of the Invention

The present invention generally relates to methods and apparatuses for straightening vehicle frames, bodies and the like or for general metal bending purposes utilizing unique components enabling the components to be quickly and efficiently assembled in a desired location and relocated when necessary with the components being utilized with a hydraulic ram or rams and a flexible member such as a chain to enable corrective forces to be applied to the component being straightened at a variable and optimum vector angle.

2. Description of the Prior Art

The art of straightening and repairing vehicle frames and bodies which have been damaged by accidents and the like has been the subject of on going developments exemplified by many issued patents discussed in detail in a separate prior art statement.

SUMMARY OF THE INVENTION

An object of the present invention is to provide a method and apparatus for straightening vehicle frames and bodies utilizing a unique base plate having a socket therein for receiving the ball at one end of a hydraulic ram to enable effective connection of the hydraulic ram to vehicle supporting runways, beams or other stationary support structures.

Another object of the present invention is to provide a method and apparatus as set forth in the preceding object in which a unique stop and socket assembly is provided for connecting the ball end of a hydraulic ram to a transverse beam and to also enable the device to be used as a stop for precluding transverse movement of the beam.

A further object of the invention is to provide a method and apparatus in accordance with the preceding objects utilizing a unique chain anchor to enable optimum vector angle of force application to be obtained and eliminating the necessity of the anchored end of the chain being provided with a hook or other special anchoring device.

Still another object of the invention is to provide a method and apparatus in accordance with the preceding objects utilizing a unique stand and clamp arrangement and a transverse crossbar supported thereby to provide a safety crossbar and enable various straightening functions to be accomplished.

A still further object of the invention is to provide a method and apparatus in accordance with the preceding objects utilizing a centrally located longitudinally extending beam supported in adjustable position and provided with a device to provide a vertical pull-down force on the item to be straightened or bent.

Yet another important object of the present invention is to provide a method and apparatus as set forth in the preceding objects in which all of the components are quickly and easily assembled, removed and relocated to enable efficient set up of the apparatus with less expenditure of physical effort and time with the apparatus also enabling optimum vector angle of force application to the structure to be bent, straightened or the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
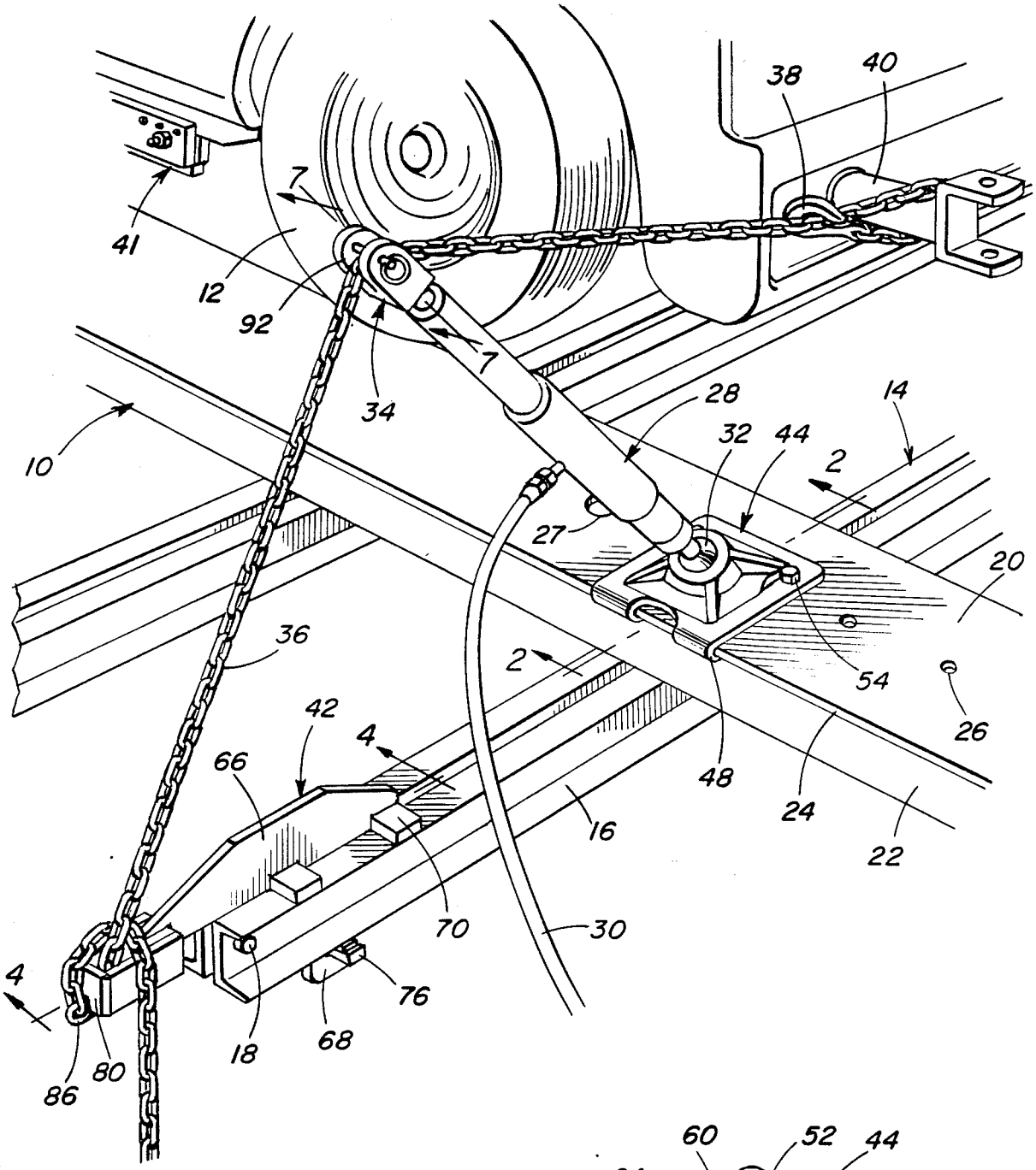
FIG. 1 is a fragmental perspective view of the apparatus of the present invention including one of the unique base plates, the chain anchor on the end of a transverse beam and a unique jack post head associated with the hydraulic ram.

Referring now specifically to FIG. 1, several components utilized in the present invention are illustrated in perspective in association with a vehicle, supporting runway structures and transverse beams. Existing equipment for the purpose of straightening and repairing vehicle bodies and frames includes an elevated support runway 10 on which vehicle wheels 12 may rest or from which the vehicle may be supported in various manners. Positioned under the runway 10 is a plurality of transverse beams 14 which generally are in the form of back to back channel-shaped members 16 secured together in spaced parallel relation by bolts 18 and suitable spacers which structure is well known. The runway 10 includes a horizontally disposed supporting surface 20 supported by channel-shaped support members 22 or the like with the edges of the horizontal surface 20 extending beyond the frame members 22 and defining edge flanges 24 with the structure of the runway 10 also being conventional except that the horizontal supporting surface 20 is provided with a plurality of centrally located, equally spaced apertures 26 extending through the support member which defines the surface 20.

A hydraulic ram generally designated by numeral 28 is connected with a source of hydraulic pressure through a hose or tube 30 in a conventional manner with one end of the ram including a ball 32 on the end thereof and the other end including a jack post head generally designated by numeral 34 for receiving a mid-portion of a flexible chain 36 having one end provided with a hook 38 so that it may be wrapped around, hooked to or otherwise attached to a vehicle component 40 which may be a portion of the frame, a forwardly projecting portion or any other portion of a vehicle generally designated by numeral 41. The other end of the chain 36 is secured to a chain anchor generally designated by numeral 42 which is attached to the end of the transverse beam 14.

Figure 3:
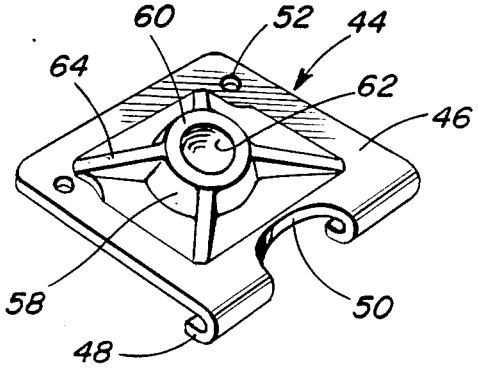
FIG. 3 is a perspective view of the base plate.
Figure 2:
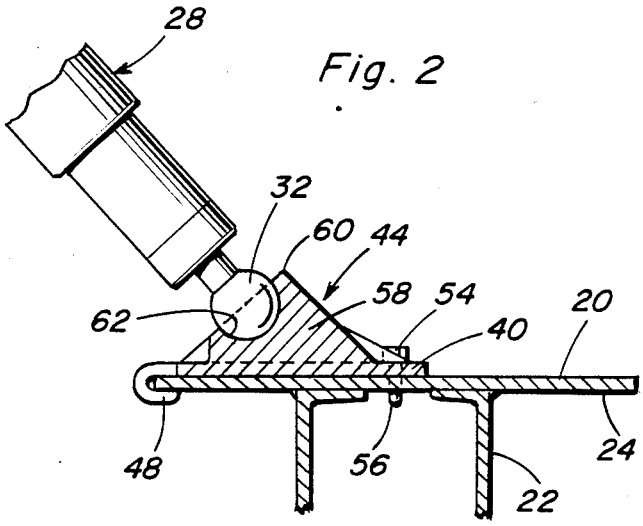
FIG. 2 is a sectional view, on an enlarged scale, taken substantially upon a plane passing along section line 2—2 on FIG. 1 illustrating further structural details of the base plate.

To overcome the problem of connecting the ram 26 in adjustable position along the runway 10 and at different angles to provide optimum orientation of the chain so that the vector angle of the force applied to the vehicle component by the chain may be optimally arranged, there is provided a base plate generally designated by the numeral 44 which is illustrated in more detail in FIGS. 2 and 3. The base plate 44 includes a generally flat plate 46 generally of square configuration with one edge thereof including a reversely curved flange 48 having a central notch 50 in the edge thereof so that the flange 48 is separated into two components each of which is generally in the shape of a hook for receiving the edge flange 24 on the runway support surface 20 as illustrated in FIG. 2. At the opposite edge of the plate 46, a pair of apertures 52 is provided with each aperture 52 having a pin 54 permanently secured thereto with the pin being in the form of a headed pin in which the head is positioned above the plate 46 and permanently secured in place as by welding or the like so that the two pins 54 depend from the bottom surface of the plate 46 and are in spaced relation such that they will engage a pair of apertures 26 with the length of the pins 54 being such that the lower ends 56 thereof will project below the support member forming the support surface 20 when the base plate 44 is assembled onto the runway 10. With the pair of pins 54 engaged with a pair of holes 26 and the reversely curved flanges 48 engaged around the edge flange 24 on the support surface 20, the base plate 44 will be securely locked in place with respect to the runway with both lateral and longitudinal movement of the base plate 44 being Precluded. Yet, the base plate 44 may be easily removed from the runway and relocated in any desired position thereon by merely lifting the edge thereof having the pins thereon upwardly to a tilted position and then sliding the reversely curved flanges 48 off of or along the edge flange 24 to a new position.

The upper surface of the base plate 46 includes an upwardly extending boss 58 that terminates in an inclined, substantially flat upper surface 60 having a partially spherical recess 62 therein for receiving the ball 32 on the end of the ram 28. Thus, the recess or socket 62 enables the positioning of the ram 28 on the base plate with a secure connection therebetween and enabling various angular positions of the ram 28 to be assumed in relation to the base plate. The boss 58 tapers upwardly as illustrated in FIG. 3 and a plurality of radial gusset plates 64 are provided between the upper surface of the base plate 46 and the boss 58 for reinforcement thereof. The boss 58 is in the form of a projection which is unitary with or secured to the plate 46 to facilitate the manufacture thereof with the boss and plate preferably being of one piece cast material or the like. The base plate 44 thus has the capacity to be positioned inboard or outboard on the runway 10 and makes it possible to swing the ram to any desired angular position to vary the angle of the chain with respect to the vehicle component 40 and with respect to the chain anchor 42 thereby obtaining optimum vector angle of the force applied to the vehicle. The base plate may also be mounted on any transverse beam, longitudinal beam or the like having a horizontal flange, apertures, slot or the like to receive the pins to enable a pull to be exerted on the vehicle which is more laterally oriented.

Figure 5:
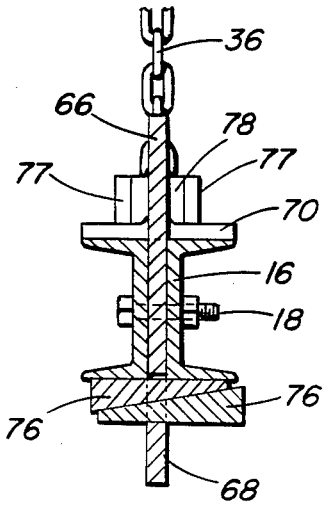
FIG. 5 is a transverse, sectional view taken substantially upon a plane passing along section line 5—5 on FIG. 4 illustrating further structural details of the chain anchor.
Figure 4:
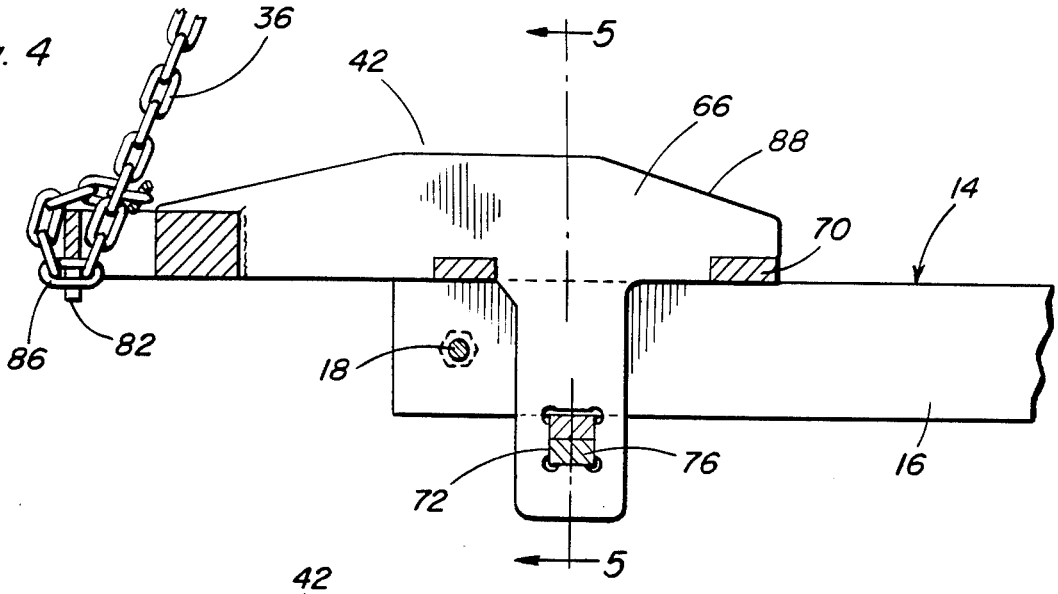
FIG. 4 is a longitudinal, sectional view taken substantially upon a plane passing along section line 4—4 on FIG. 1 illustrating further structural details of the chain anchor.
Figure 6:
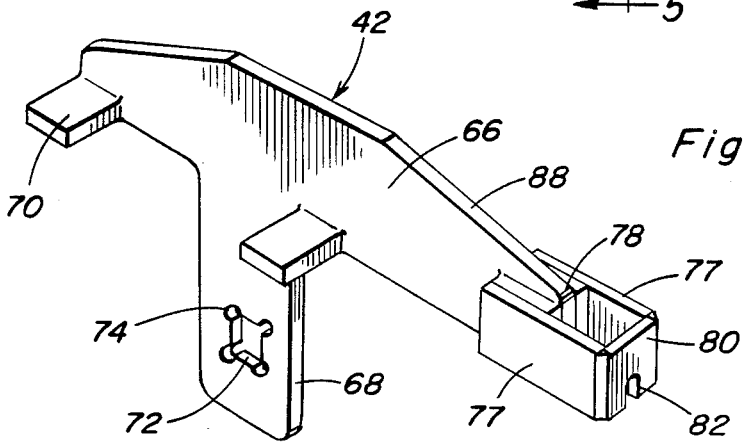
FIG. 6 is a perspective view of the chain anchor.

FIGS. 4, 5 and 6 disclose the specific structure of the chain anchor 42 which includes a generally vertically disposed plate 66 having a depending centrally located blade or projection 68 along the lower edge thereof and laterally projecting horizontal lugs 70 at longitudinally spaced points on each side of the plate 66 along the bottom edge thereof which rest on the upper surface of the flanges on the channels 16 which form the beam 14 as illustrated in FIGS. 4 and 5. The depending member 68 is closer to one end of the plate 66 than the other as illustrated in FIG. 4 and includes a generally square aperture 72 adjacent the lower end thereof with the corners of the aperture 72 being cut out or recessed generally in the form of a partial cylindrical surface as indicated by numeral 74 with the aperture receiving a pair of oppositely disposed wedges 76 as illustrated in FIGS. 4 and 5 which engage the bottom surface of the flanges forming the beam 14 to rigidly but adjustably secure the chain anchor 42 to the transverse beam 14. The outer end of the plate 66 is provided with a pair of short longitudinal plates 76 spaced from the opposite surfaces of the plate 66 as by spacers 78 with the ends of the plate 76 being interconnected by a vertical plate 80 having a U-shaped notch 82 in the lower edge of the center thereof as illustrated in FIG. 6. Thus, the plates 76 and 80 provide a vertical passageway 84 for the chain 36 so that the free end of the chain 36 may be dropped down through the passageway 44 and then pulled upwardly so that one link 86 of the chain 36 will engage the downwardly opening notch 82 as illustrated in FIG. 4 thus locking the chain to the anchor 42. The free end of the chain 36 is then moved upwardly and wrapped inwardly around the portion of the chain 36 which extends upwardly from the chain anchor 42 and dropped downwardly over the top and opposite surface of the plate 76 as illustrated in FIG. 1 so that gravity retains the chain 36 locked adjustably to the chain anchor 42. The top edge of the plate 66 has beveled end corners 88 to eliminate sharp corner edges that could possibly cause injuries and catch on various items such as the chain links and the like. The adjustment of the chain anchor 42 enables optimum orientation of the chain 36 in order to improve the vector angle on the chain. Also, this type of chain anchor eliminates the necessity that the chain 36 have a hook on the end of the chain that is connected to the anchor. Further, it facilitates connection of the chain by enabling the chain merely to be dropped through the passageway 84 and then pulled outwardly and upwardly through the keyhole slot 82 and then looped back over and down as illustrated in FIGS. 1 and 4 so that the weight of the chain hanging to the floor will hold the chain link in the slot.

Figure 7:
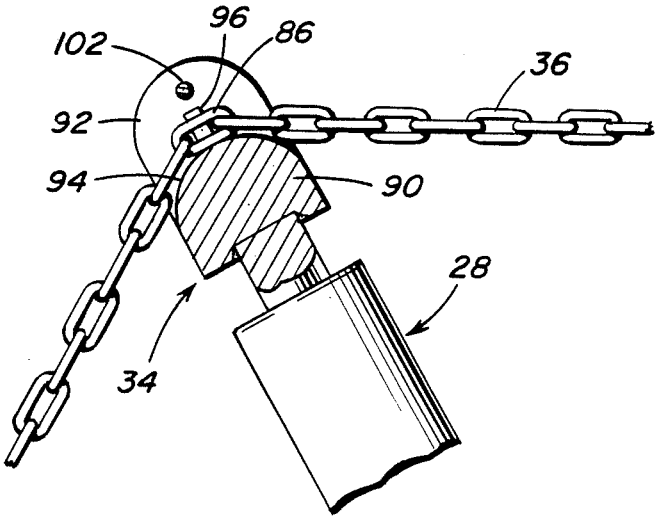
FIG. 7 is a sectional view, on an enlarged scale, taken substantially upon a plane passing along line 7—7 on FIG. 1 illustrating further structural details of the jack post head.
Figure 8:
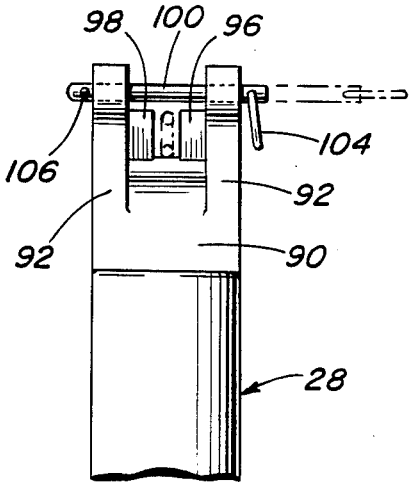
FIG. 8 is a side elevational view of the jack post head.
Figure 9:
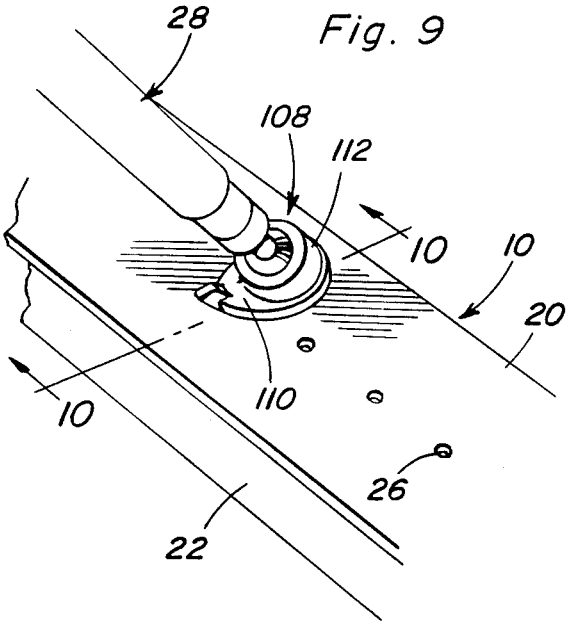
FIG. 9 is a fragmental perspective view illustrating another base plate for supporting the hydraulic ram.

FIGS. 7 and 8 illustrate the details of the jack post head 34 at the upper end of the hydraulic ram 28 for applying the force exerted by the ram 28 to the chain 36. The jack post head 34 includes a generally U-shaped assembly which includes a transversely extending member 90 rigidly connected with the upper end of the hydraulic ram in a conventional manner with a pair of substantially parallel projecting lugs 92 at the edges of the transverse member 90 as illustrated in FIGS. 7 and 8. The surface area of the transverse member 90 between the lugs 92 is arcuately curved into generally a semi-cylindrical configuration as indicated by numeral 94 and a pair of inwardly extending lugs 96 are provided at the juncture of the apex of the curved surface 94 and the inner surfaces of the lugs or ears 92 with the projecting lugs 96 terminating inwardly of the apex of the arcuately curved outer end of the lugs or ears 92 as illustrated in FIG. 8. The lugs 96 are spaced from each other thereby providing a locking slot or notch 98 to receive a link 86 of the chain 36 as illustrated in FIGS. 7 and 8 thereby locking the jack post head 34 longitudinally along the length of chain 36 at any desired position. To retain the chain link 86 in the notch 98, a transversely extending locking pin 100 is provided which extends through aligned apertures 102 in the lugs or ears 92 with the apertures disposed just outwardly of the outer ends of the lugs 96 so that when the pin 100 is in place, the chain link 86 will be retained in the notch 98. The locking pin 100 may be provided with a pivoted ring 104 at one end thereof and a transverse locking pin or key element 106 at the other to retain the pin 100 releasably through the apertures 102. In this construction, the locking pin 102 is not a load bearing pin but is only a safety pin to make certain that the chain 36 does not become disengaged from the notch 98. When assembling the components, it is only necessary to secure the chain to the vehicle and then drop the chain in-between the lugs or bars 96 and the weight of the chain will hold the chain and ram in assembled relation with the ram 28 at the desired angular position. Thus, the weight of the chain will hold the chain in position while the pin 100 is being inserted and while the lower end of the chain 36 is being secured to the chain anchor 42. This arrangement enables quick and easy assembly of the components and also easy disassembly for reorientation in order to obtain desired vector angle of force application to the vehicle.

Figure 10:
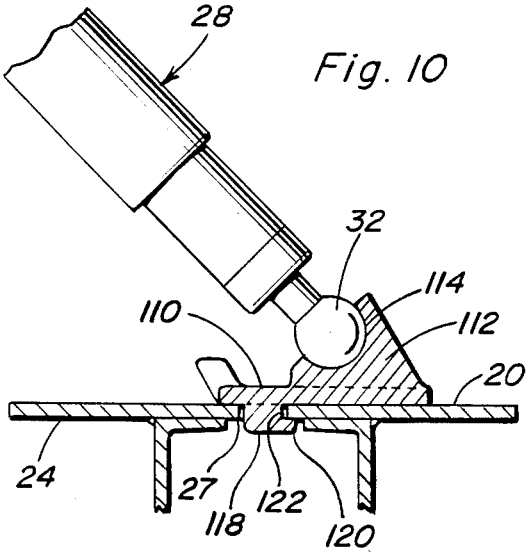
FIG. 10 is a sectional view, on an enlarged scale, taken substantially upon a plane passing along section line 10—10 on FIG. 9 illustrating further structural details of the base plate.
Figure 11:
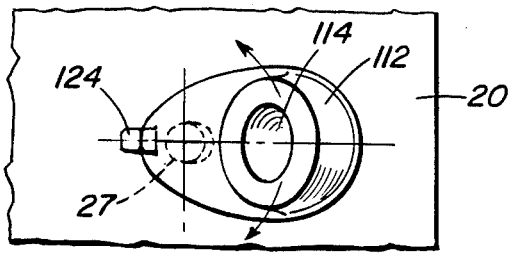
FIG. 11 is a plan view of the base plate of FIG. 9 illustrating the manner in which it can be angularly positioned in relation to the supporting surface.
Figure 12:
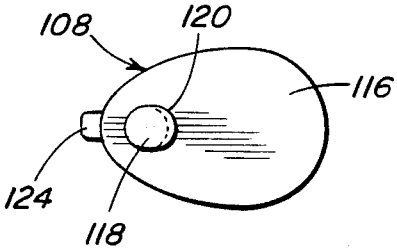
FIG. 12 is a bottom plan view of the base plate illustrated in FIG. 9.

FIGS. 9–12 illustrate another type of base plate generally designated by numeral 108 that is attached to the runway 10 by utilizing a large aperture 27 in the supporting surface 20 and is used to connect the ram 28 to the runway 10 in which the ram 28 is identical to that illustrated in FIG. 1 and provided with a ball 32 on the lower end thereof. The base plate 108 includes a substantially flat plate 110 of oval or teardrop shape in plan configuration as illustrated in FIGS. 11 and 12 with the upper surface thereof including an upwardly extending and inclined boss 112 having a socket 114 in the inclined upper surface thereof for receiving the ball 32 in generally the same manner as the connection between the ball 32 and the base plate 44. The bottom surface of the plate 110 is substantially planar as at 116 and is provided with a depending projection 118 in the form of a cylindrical member which will pass through the aperture 27. The lower end of the projection 118 is provided with a lateral projection 120 which defines a laterally opening groove 122 between the projection 120 and the bottom surfade 116 of the plate 110 as illustrated in FIG. 10. This structure provides a substantially hook-shaped structure that will pass through the aperture 27 so that the peripheral edge of the aperture 27 will enter the groove 122 when lateral force is exerted on the plate 110 in a direction radially of the aperture 27 thus securing the base plate 108 to the runway 10. FIG. 11 illustrates the manner in which the base plate 108 can be swung in an arcuate manner so that the base plate 108 can be oriented in any angular relation around the aperture 27 to facilitate adjustable positioning of the ram 28. The projection or dog 118 securely retains the base plate 108 in any lateral direction so that the ram can be oriented in any lateral position with the base plate 108 being pivotal in any direction about an axis defined by the depending projection 118. The upper surface of the plate 110 is provided with an upwardly inclined tab or projection 124 opposite to the end having the boss 112 thereon to facilitate lifting and handling of the base plate 108. The dimensions of the projection or dog 118 is such that it will closely pass through the aperture 27 and when it is moved laterally in a direction away from the tab or projection 124, the groove 122 will receive the edge of the aperture 27 to lock the base plate 108 in position on the runway 10 but still enable swinging movement thereof about the axis of the projection 118.

Figure 13:
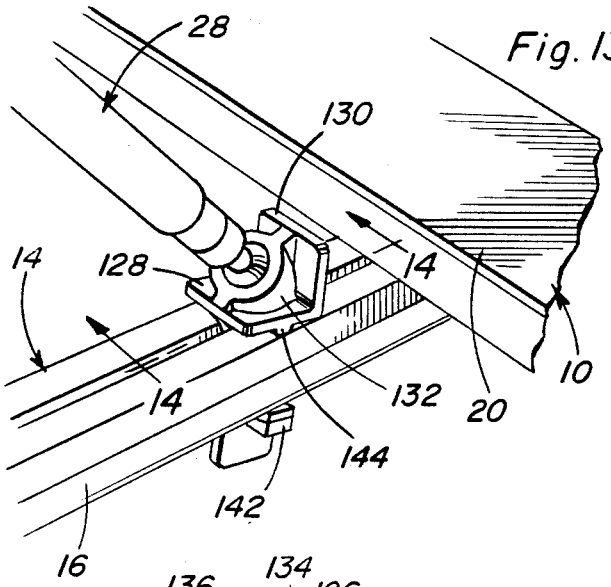
FIG. 13 is a fragmental perspective view illustrating a socket and stop assembly utilized to support the lower end of a hydraulic ram or form a stop for limiting movement of a transverse beam.
Figure 14:
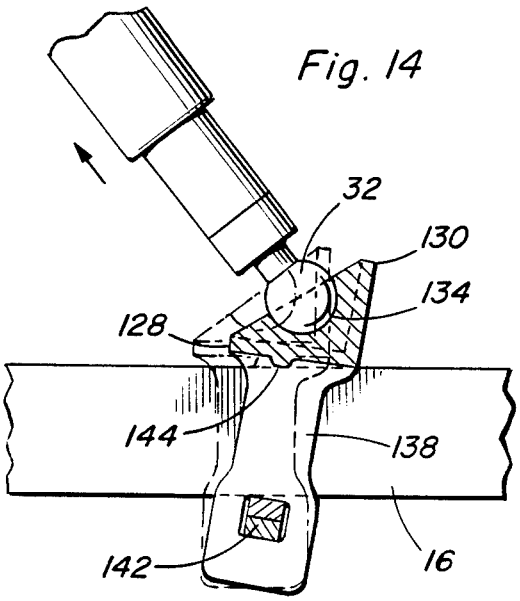
FIG. 14 is a vertical sectional view, on an enlarged scale, taken substantially upon a plane passing along section line 14—14 on FIG. 13 illustrating further structural details of the socket and stop assembly.
Figure 15:
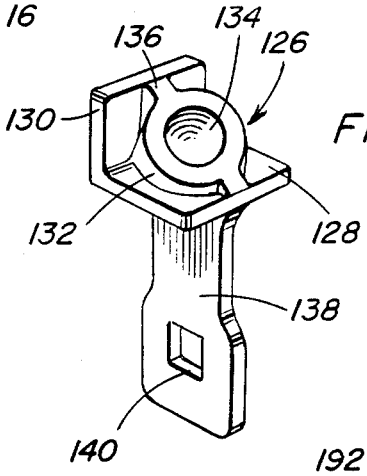
FIG. 15 is a perspective view of the stop and socket assembly.

FIGS. 13–15 disclose a socket and stop assembly generally designated by numeral 126 and which is associated with the transverse beam 14 for adjustably connecting the ram 28 to the transverse beam 16 and also serving as a stop to limit movement of the transverse beam in relation to the runway 10. The socket and stop assembly includes a generally horizontal plate 128 having a vertical plate 130 at one edge thereof with an upwardly extending inclined boss 132 on the upper surface of plate 128 with the boss 132 including a socket 134 for receiving the ball 32 on the lower end of the ram 28 in a manner similar to the base plates disclosed in FIGS. 1–2 and FIGS. 9–12. The boss 132 is reinforced by gussets 136. Depending from the center of the plate 132 is a projection or blade 138 which extends down between the channel-shaped members 16 defining the beam 14 with the lower end of the projection 138 including a square aperture 140 receiving a pair of oppositely disposed wedges 142 with the structure of the aperture 140 and the wedges 142 being similar to the structure for securing the chain anchor to the transverse beam 14. The bottom surface of the plate 128 includes a depending transverse rib or projection 144 which is located generally centrally of the surface of the plate 128 generally in alignment with the aperture 140 so that if the socket assembly 126 pivots through the locking positions illustrated in FIG. 14, the edge of the plate 128 having the upstanding plate 130 integral therewith will contact the upper surface of the flanges on the channel members that form the beam 14 and the corner of the wedges 142 will cooperate with the rib 144 and edge of the plate 128 to securely lock the socket and stop assembly in position on the transverse beam 14. The socket and stop assembly will receive the ball on the lower end of the ram and lock the lower end of the ram in any position on the transverse beam or longitudinal stretch beams when used. After the wedges are driven in, there would be a tendency for the assembly to slip on the transverse beam but this is prevented by the upper end of the assembly moving a small distance to securely bind and lock it in position. A second function of the socket and stop assembly is to lock the transverse beam from moving transversely in relation to the runway thereby securing the transverse beam in place while forces are being exerted thereon. It also can be turned so that the upwardly extending plate 130 can serve as a jack base in order to provide an abutment or stop for the jack base so that forces can be exerted by the jack.

Figure 16:
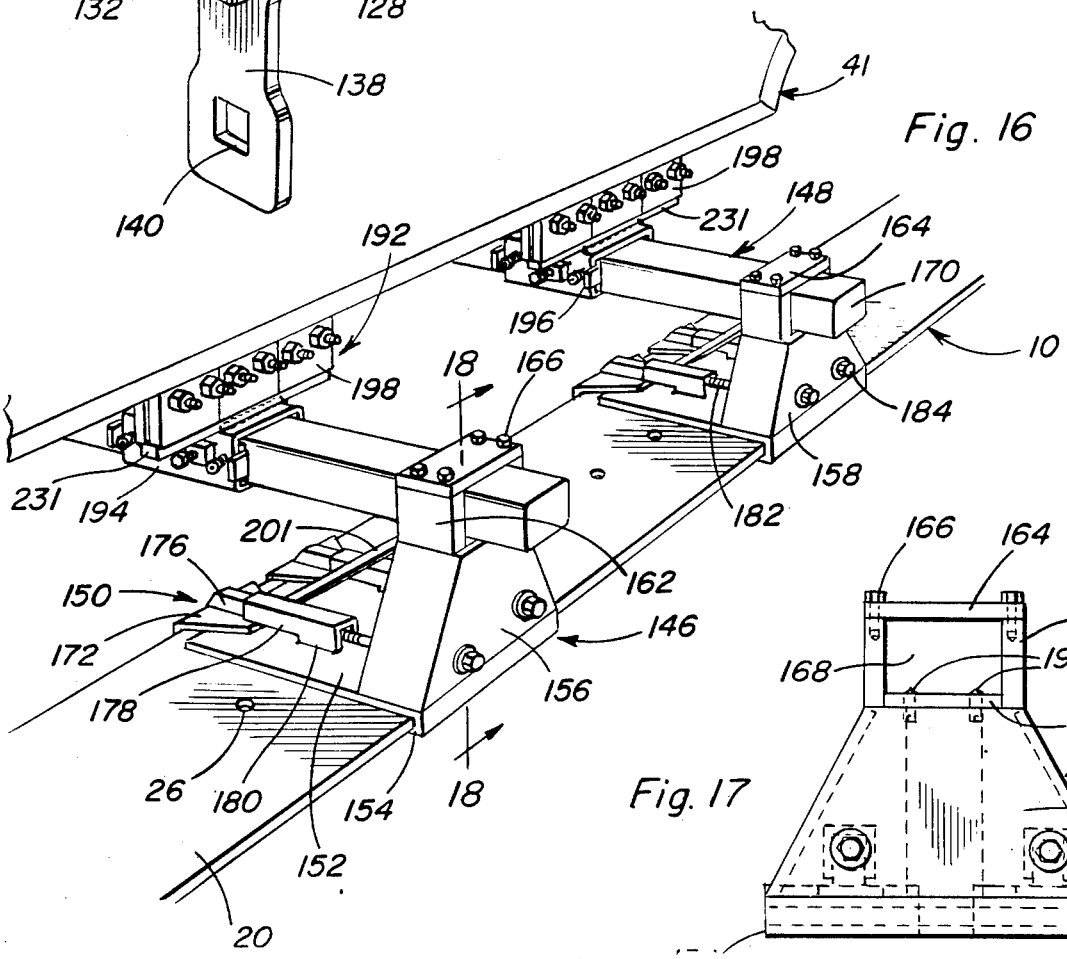
FIG. 16 is a fragmental perspective view illustrating a pair of jack stands supporting crossbars connected to the vehicle and clamp structures for securing the stands to a supporting runway.
Figure 17:
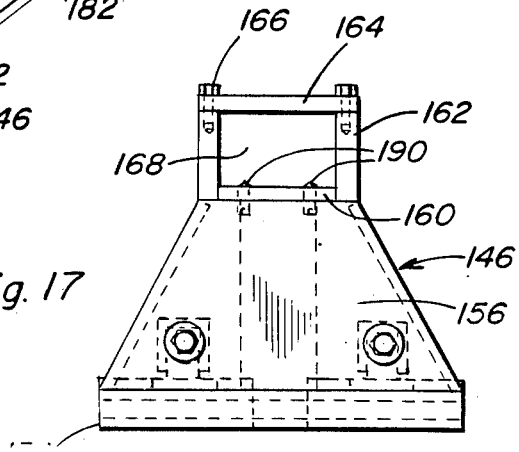
FIG. 17 is a side elevational view of one of the stands.
Figure 18:
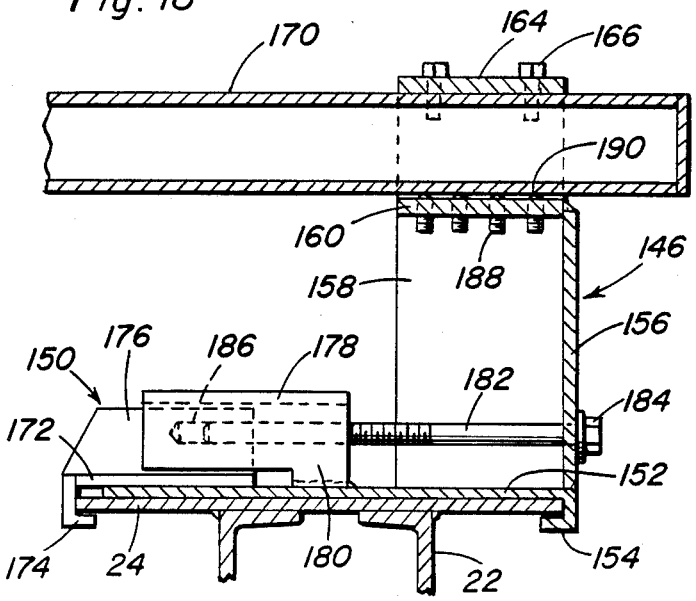
FIG. 18 is a vertical sectional view, on an enlarged scale, taken substantially upon a plane passing along section line 18—18 on FIG. 16 illustrating further structural details of the stands and the connection of the transverse crossbar to the stand.

FIGS. 16–18 illustrate a stand generally designated by reference numeral 146 for clamping attachment to the runway 10 to support crossbars generally designated by numeral 148. The stands 146 include a clamp structure generally designated by numeral 150 at the lower end thereof which includes a base plate 152 having a reversely curved flange 154 at one edge thereof for engaging the edge flange 24 on the surface 20 forming the runway 10. Projecting upwardly from the upper surface of the plate 152 is a vertical end plate 156 and inclined side plates 158 with the end plate 156 flush with the reversely curved end of the plate 152 and the side plates 158 inclined upwardly from the side edges of the plate 152 as illustrated in FIGS. 16–18. The upper end of the plates 156 and 158 are rigidly interconnected by a top plate 160 with a pair of generally rectangular upstanding side plates 162 being provided at the opposite ends of the plate 160 with all of these components being of rigid construction and rigidly associated with each other as by welding or the like. Extending across the two upstanding side plates 162 is a retaining cap or plate 164 secured in place by fastening bolts 166 which extend through the plate 164 into the side plates 162 thereby defining a generally rectangular area 168 which receives the ends of the crossbars 148 which are in the form of rectangular structural members which may be hollow or solid depending upon the strength requirements.

To secure the plate 152 to the runway 10, the clamp structure 150 includes movable plates 172 overlying the plate 152 each provided with a reversely curved flange edge 174 to hook around the edge flange 24 opposite to the reversely curved flange 154 as illustrated in FIG. 18. The upper surface of the plate 172 is provided with an upwardly extending projection 176 which is generally rectangular in cross-sectional configuration for telescoping guided relation to a pair of rectangular projections 178 on the top surface of plate 152 with the projections 178 being secured to the plate 152 only at an inner end portion thereof as indicated by numeral 180 so that the plates 172 can slide under the end portions of the projection 178 as illustrated in FIG. 18. A pair of elongated bolts 182 extend through the plate 156 and are provided with a bolt head and washer 184 on the end thereof outwardly of the plate 156 and extend through the projections 178 into a threaded socket or nut 186 in each projection 176 so that by rotating the bolts 182 by placing a suitable wrench or other tool on the bolt head 184, the clamp structure 150 may be manipulated in order to securely clamp the stand 146 in adjusted position on the runway 10, enable longitudinal adjustment thereof and enable attachment and removal of the stands 146 in a quick and easy manner. The top plate 160 is provided with a plurality of setscrews 188 threaded therethrough from the bottom with the upper ends of the setscrews being pointed as at 190 for biting into the crossbar 170 to securely retain the crossbar 170 in position on the stand 146. The crossbars 170 may be secured to the vehicle 41 by clamps 192 each of which includes a sleeve 194 mounted on the crossbar 170 in a manner set forth hereinafter. Also, as illustrated in FIG. 16, an inclined reinforcing gusset 201 may be provided between the inner end of the plate 152 and the top plate 160 with the clamp plates 172 being in the form of two separate plates separated from each other as illustrated in FIG. 16 so that the two clamp plates 172 are individually operated by the bolts 182 to compensate for variations in the dimensional characteristics of the width of the runway 10. With this construction, the crossbars can be rigidly secured to the runway and the stands can be quickly and easily positively to to the runways in adjusted position in a quick and easy manner and can be easily removed individually for accessibility. The stands can be adjusted forwardly and rearwardly for different lengths vehicles and for alignment with different points or positions on the vehicle and the cross bars 170 provide for additional safety in maintaining the vehicle in position and also can be jacked up or pulled down individually to untwist a vehicle frame or the like. The clamps 192 can be adjusted for different clamping points on which the vehicle and any one or two clamps can be removed to allow working space in specific area of the vehicle. FIGS. 22–26 illustrate the details of the clamps 192 which connect the crossbars 170 to the depending rocker panel flange 195. The clamp 192 includes an upstanding plate 196 rigidly affixed to the upper surface of sleeve 194 by welding and reinforcing gussets 197. Three movable plates 198 are connected to plate 196 by a plurality of clamp bolts 199 and the plate 196 includes a plurality of pointed set screws 200 projecting toward plates 198 to secure the clamp to the flange 195 in a positive manner. The bottom edge of plate 196 includes a ledge member 231 welded thereto which supportingly engages the bottom edge of plates 198 and the inner surface of each clamping plate 198 includes a plurality of sockets 232 aligned with the set screws 200. As illustrated, the set screws 200 are adjustable and the set screws 200 and sockets 232 are disposed adjacent the upper edge of plates 196 and 198 so that portions of the flange 195 can be partially deformed into the sockets 232 to securely retain the clamp on flange 195.

Figure 25:
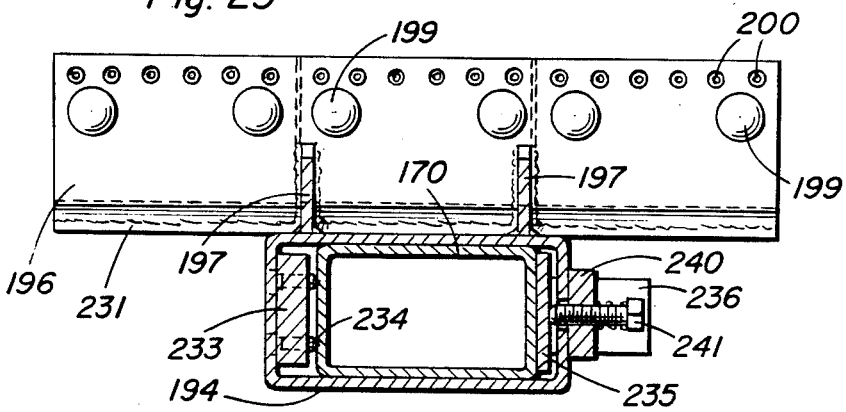
FIG. 25 is a sectional view of the clamp taken along section line 25—25 on FIG. 22.
Figure 26:
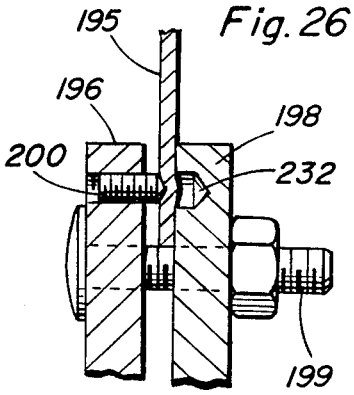
FIG. 26 is a fragmental sectional view of the clamp plates and flange clamped therebetween.

The sleeve 194 is rectangular and encircles the crossbar 170 and includes a reinforcing plate 233 along the inner surface of one wall with set screws 234 extending through the side wall of the sleeve and the plate 233 and projecting inwardly thereof for frictional locking engagement with the sidewall of crossbar 170. The other sidewall of sleeve 194 includes a pressure plate 235 disposed interiorly of the sleeve with a pair of end tabs or flanges 236 at the ends thereof which extend laterally of the end edges of the sidewall of the sleeve 194 which form handles for the pressure plate 235. The pressure plate 235 includes a pair of shouldered headed screws 237 attached thereto and extending outwardly through apertures 238 in the sidewall of sleeve 194. A compression coil spring 239 is mounted on each screw 237 and bias the pressure plate away from crossbar 170. The outer surface of the sidewall of sleeve 194 which has the shouldered screws 237 extending therethrough is provided with a boss or plate 240 welded thereto with a lock bolt 241 being screw threaded therethrough into abutting engagement with the pressure plate or lock plate 235 to force the pressure plate inwardly to lock the sleeve 194 on the crossbar 170 by clamping engagement of opposite sidewalls of opposite sidewalls of the crossbar 170 by the pressure plate 235 and the set screws 234 as shown in FIG. 25.

With this arrangement, the stands support the clamps 192 which in turn are secured to the vehicle thereby locking the vehicle from movement while corrections are being made on the body. The stands are adjustable on the runways and the clamps are adjustable on the crossbars and the crossbars can be adjusted on the stands. Also, the clamps are constructed so one or more may be removed to provide working space under the vehicle in certain areas. Likewise, the stands can be removed as necessary so that the crossbars can be used as jacking points or pull down points in the body correction process. Also, the friction pressure plate and set screws which engage the hollow crossbars avoids crushing the hollow crossbars.

Figure 19:
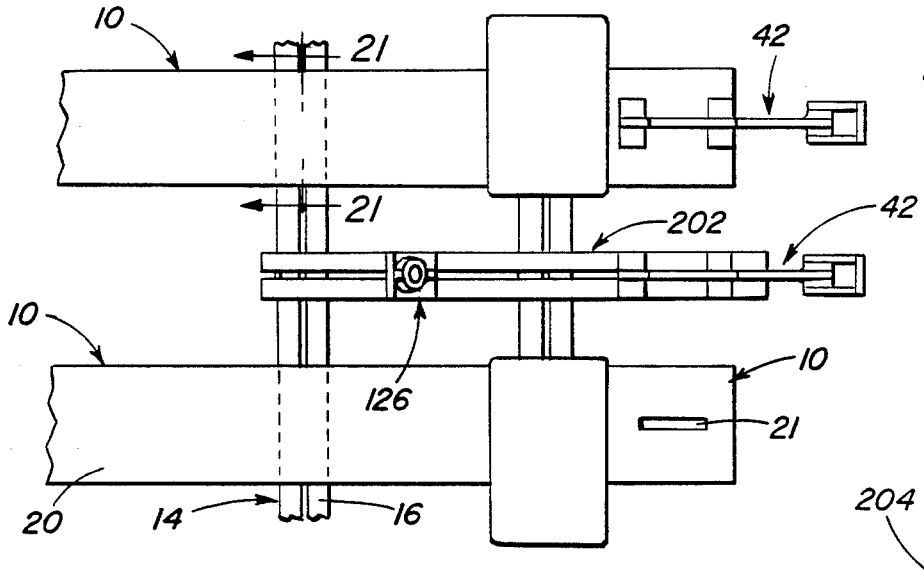
FIG. 19 is a schematic plan view illustrating a centrally located longitudinally extending stretch beam capable of supporting various of the components of the present invention.

FIG. 19 illustrates schematically an arrangement in which a stretch beam generally designated by numeral 202 is associated with the front end of existing runways 10 in which the stretch beam 202 is of the same construction as the transverse beams 14 and may be located at any point between the runways 10. A similar arrangement may be provided at the rear of the existing runways. Mounted on the stretch beam 202 is a chain anchor 42 and a socket and stop assembly 126. This illustration is to emphasize the versatility of the present arrangement of components since the stretch beam itself can be moved longitudinally or laterally of the transverse beams, the chain anchor may be moved longitudinally thereof and the socket and stop assembly may be moved longitudinally or reversed. The runways, provided with the apertures may be provided with any of the base plates associated with the holes 26 or the larger hole 27 for the swivel base plate 108. The runways may also be provided with rectangular slots 21 to receive the depending blade on a chain anchor 42.

Figure 20:
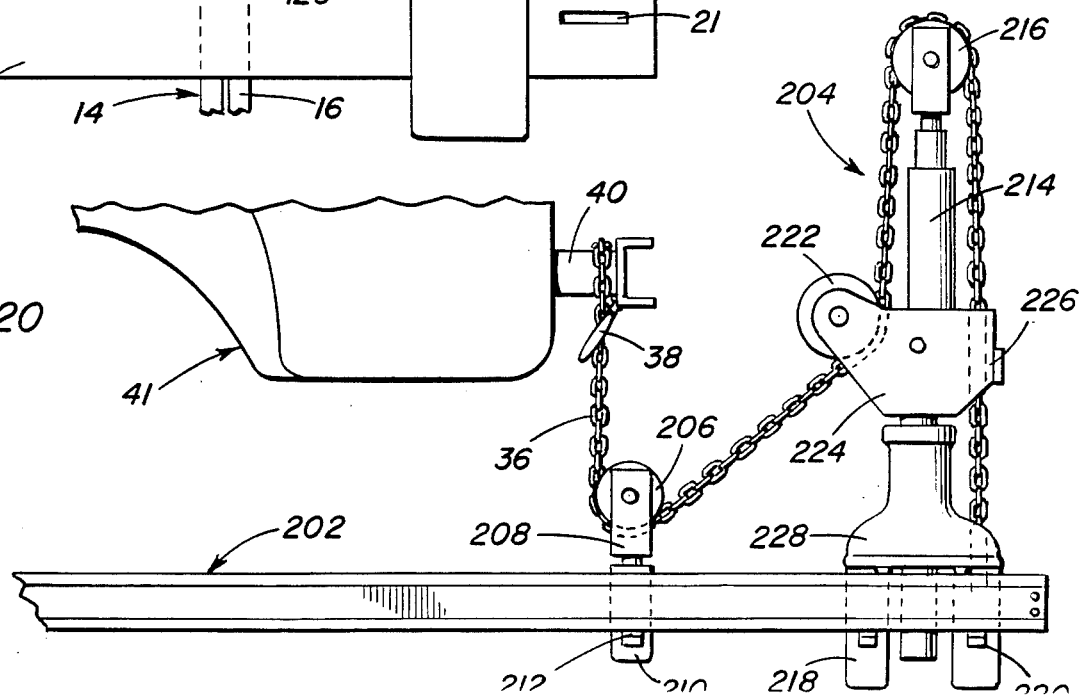
FIG. 20 is a side elevational view illustrating an assembly for exerting a vertical pull-down force on a vehicle frame or component.
Figure 22:
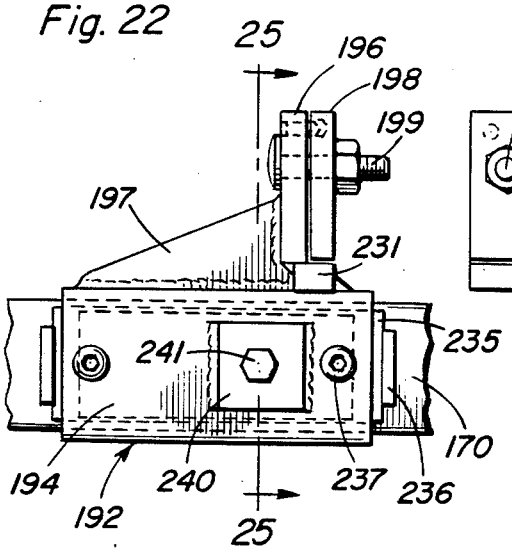
FIG. 22 is a side elevational view of the clamp mounted on a crossbar.
Figure 23:
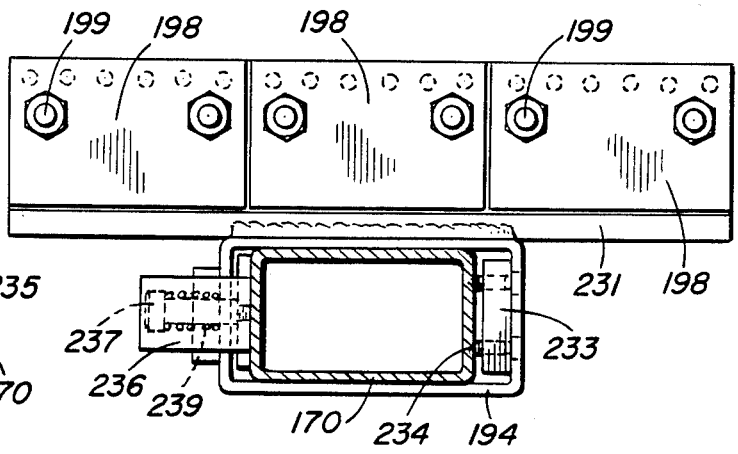
FIG. 23 is an end view of FIG. 22.
Figure 24:
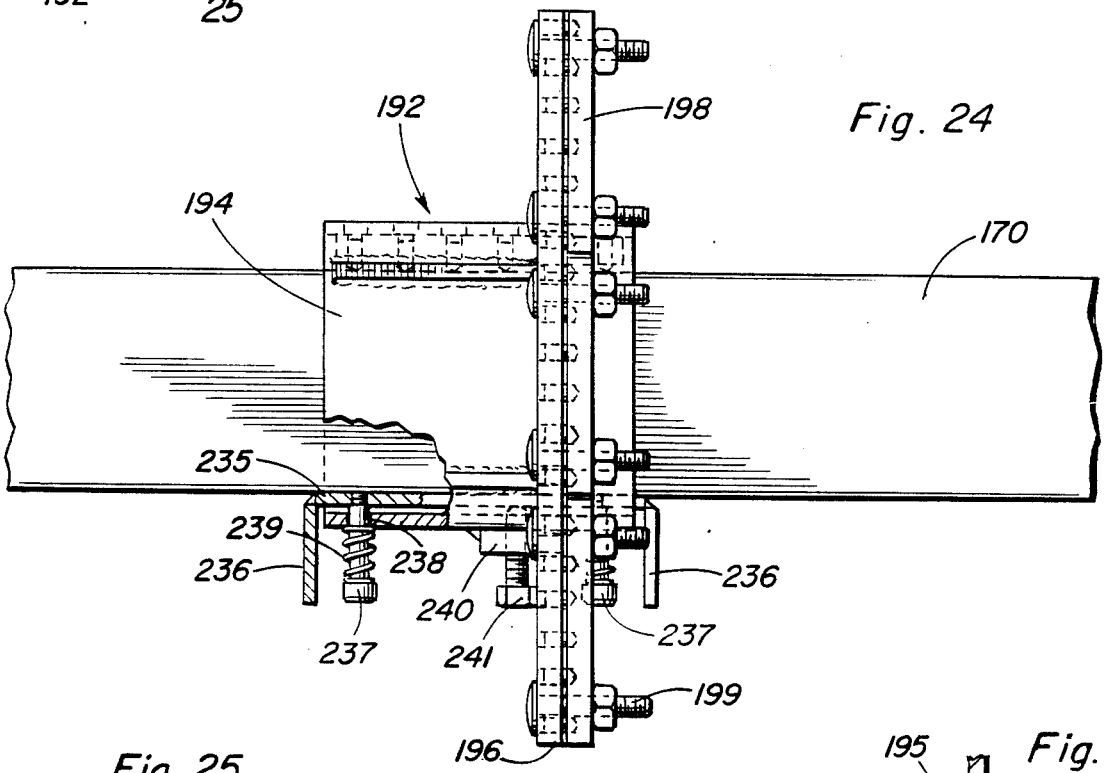
FIG. 24 is a top plan view of FIG. 22 with portions broken away.

FIG. 20 illustrates a down pull device generally designated by numeral 204 that may be mounted on the stretch beam 202 or one of the transverse beams 14 with this structure including a chain 36 which is entrained under a pulley or guide 206 supported by a bracket 208 that may be rigid with or swivelly connected to an anchor projection 210 secured to the stretch beam 202 by opposite wedges 212 in the same manner that the socket and stop assembly 126 is secured to the beam 14. The pull down device also includes a vertical tower structure 214 having a pulley 216 mounted at the upper end thereof for receiving the chain 36 and the lower end of the tower includes projections 218 secured to the beam 202 by wedges 220 in a known manner. Also, an intermediate portion of the tower is provided with a pulley 222 mounted on a suitable bracket structure 224 with the chain 36 entrained under the pulley 222 and over the pulley 216 and downwardly through an anchor device 226. The tower 214 includes a base 228 that is supported on the stretch beam 202 or the transverse beams and beams and incorporates a hydraulic ram to vertically elevate the pulley 216 thereby exerting a downward pull on the component 40 of the vehicle 41 thus further increasing the versatility and universal utility of the invention.

Figure 21:
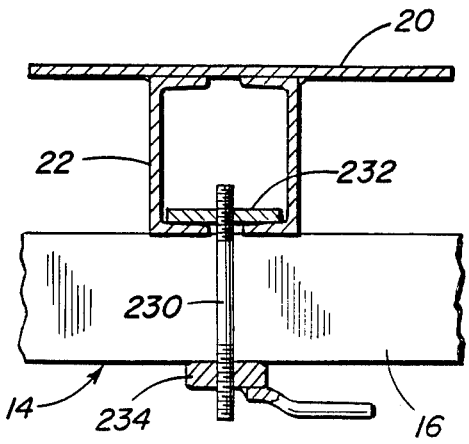
FIG. 21 is a sectional view taken substantially along section line 21—21 on FIG. 19 illustrating the adjustable connection between the transverse rails and drive-on runways.

The runways are supported in elevated position above a floor surface in a conventional and well known manner in accordance with existing and known structures and can be adjusted for different width vehicle tracks. Various arrangements of the unique base plates and other components may be utilized depending upon the requirements for each individual situation that may be encountered. The arrangement of components enables omni-directional pull or push around the perimeter of the vehicle and renders the assembly completely directional under the vehicle while increasing the safety factor by reducing the height that a vehicle has to be lifted in some instances with most of the weight of the vehicle being left on the tires while locking the vehicle to the machine. The crossbars add an additional safety factor in case the vehicle should pull loose from the clamps or attachment points. Also, various types of pushing and pulling implements may be used including the types specifically illustrated or equivalent types. The transverse beams are supported below the runways, as shown in FIG. 21, by a threaded bolt 230 extending down through the beam 16 and being screw-threadably secured to the runway at the upper end by a plate 232 resting on the inturned flanges on the channels 22 and provided with a nut and handle assembly 234 at the lower end. This structure enables the transverse beam to be slid back and forth both to the front and rear and transversely of the drive-on runways. Operation of the machine will not preclude normal operation of the turntables normally provided at the front end of the runways for receiving the front wheels of the vehicle. By combining the various base plates, jack post heads, socket and stop assembly, chain anchors, stands and crossbar in various arrangements, multiple direction pull and push may be obtained along with an assembly which can be quickly and easily adapted to each individual job in an efficient manner requiring the expenditure of a small amount of time and less physical energy and enabling the use of smaller and lighter weight components by enabling optimum application of force to the vehicle at optimum vector angles.

The base plates and other components of the present invention have sufficient strength requirements to transfer the reaction force of the ram or chain to the runway, transverse rail or other support structure. This arrangement has multiple uses including auto frame repair, alignment, underside repair and the like. The assembly enables the vehicle to be more efficiently and quickly repaired by providing a rigidly affixed frame structure that is inherently more safe than various portable units. The base plate bosses are inclined approximately 35° from perpendicular and are inclined outward, that is toward the reversely curved flange end or toward the handle tab end and away from the vehicle. The gussets for the supporting socket reinforces the socket or boss to enable reduction in weight while maintaining strength characteristics all of which increases the versatility of the apparatus and enables a unique method of assembly of components and application of force at optimum vector angles with respect to the vehicle. The base plates may be pointed inward to push or pull inwardly as well as outwardly. The equipment is usable and workable under the vehicle as well as around the perimeter. The use under the vehicle is enhanced by the light weight hollow crossbars which have maximum strength for least weight and which include friction locking plates to avoid crushing the hollow tubes.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a vehicle frame straightening apparatus utilizing a hydraulic ram and a flexible chain connected to a vehicle component to be straightened, that improvement comprising a base plate having means on the upper surface thereof for connection with the lower end of a hydraulic ram in order to support the ram in upwardly extending position, said base plate including a substantially planar lower surface adapted to be supported on a horizontally disposed supporting surface and transfer the reaction force from the ram to the supporting surface and means spaced from the means connecting the ram and base plate for precluding upward movement of the base plate in relation to the supporting surface by engagement with a downwardly facing surface on the supporting surface thereby securely retaining the base plate on the supporting surface while enabling adjustment of the base plate in relation to the supporting surface and orientation of the base plate in different positions in relation to the supporting surface, said means retaining the base plate on the supporting surface including a downwardly and inwardly extending reversely curved edge on one edge portion of the base plate to provide a hook-shaped structure to engage over an edge of a supporting runway to enable assembly and disassembly of the base plate and adjustment of the base plate along the edge of the supporting runway with lateral movement being precluded by the reversely curved edge.

2. The structure as defined in claim 1 together with depending pin means on the base plate remote from the curved edge engageable with apertures in the runway to preclude longitudinal movement of the base plate in relation to the runway when the base plate has its planar surface in engagement with the runway.

3. The structure as defined in claim 2 wherein said pin means includes a pair of depending pins fixedly attached to the plate and depending from the planar surface for reception in holes in the runway, said means on the base plate receiving reaction force from the ram including an upwardly opening socket receiving a portion of the lower end of the ram.

4. In a vehicle frame straightening apparatus utilizing a hydraulic ram and a flexible chain connected to a vehicle component to be straightened, that improvement comprising a base plate having means on the upper surface thereof for connection with the lower end of a hydraulic ram in order to support the ram in upwardly extending position, said base plate including a substantially planar lower surface adapted to be supported on a horizontally disposed supporting surface and transfer the reaction force from the ram to the supporting surface and means spaced from the means connecting the ram and base plate for precluding upward movement of the base plate in relation to the supporting surface by engagement with a downwardly facing surface on the supporting surface thereby securely retaining the base plate on the supporting surface while enabling adjustment of the base plate in relation to the supporting surface and orientation of the base plate in different positions in relation to the supporting surface, and a chain anchor provided for anchoring the chain remotely from the vehicle, said chain anchor comprising a substantially vertical passageway defined by a peripheral wall having a downwardly opening notch in the lower edge thereof whereby the chain may be passed downwardly through the passage and pulled outwardly with one link engaging the notch with the remainder of the chain being looped over the anchor and hung downwardly whereby the weight of the chain will retain the chain link in the notch thereby locking the chain to the anchor without requiring hooks or the like on the end of the chain.

5. The structure as defined in claim 4 wherein said supporting surface includes a transverse beam, said chain anchor including an elongated vertical plate extending longitudinally of the beam and having laterally projecting means engaging the upper surface of the beam and a depending projection extending through the beam and provided with a transverse aperture receiving wedge means clampingly engaging the bottom of the beam thereby locking the plate to the beam, said projection having a width substantially less than the length of the plate.

6. The structure as defined in claim 5 together with means connecting the upper end of the ram to the chain, said means comprising a jack head post having a transverse member and a pair of outwardly projecting lugs receiving the chain therebetween against the transverse member, a pair of inwardly extending lugs rigid with the transverse member and outwardly extending lugs with the transverse lugs terminating in spaced relation to define an outwardly opening notch receiving one link of the chain to retain the ram in predetermined angular relation to the chain when the chain is assembled with the outer end of the ram thereby enabling the chain and outer end of the ram to be retaining in assembled relation while the end of the chain remote from the vehicle is attached to a chain anchor.

7. The structure as defined in claim 6 together with a pin paralleling the transverse member outwardly of the lugs to retain the chain link in the notch between the transverse lugs.

8. In a vehicle frame straightening apparatus utilizing a hydraulic ram and a flexible chain connected to a vehicle component to be straightened, that improvement comprising a base plate having means on the upper surface thereof for connection with the lower end of a hydraulic ram in order to support the ram in upwardly extending position, said base plate including a substantially planar lower surface adapted to be supported on a horizontally disposed supporting surface and transfer the reaction force from the ram to the supporting surface and means spaced from the means connecting the ram and base plate for precluding upward movement of the base plate in relation to the supporting surface by engagement with a downwardly facing surface on the supporting surface thereby securely retaining the base plate on the supporting surface while enabling adjustment of the base plate in relation to the supporting surface and orientation of the base plate in different positions in relation to the supporting surface, said base plate including a generally flat plate with an upstanding plate at one edge thereof and a depending projection adapted to be locked to the support surface, and an upwardly inclined socket between the two plates and connected thereto by gussets for connection with the lower end of the ram, said supporting surface being a transverse beam, said base plate including a depending projection extending through the beam and having a transverse aperture therein receiving wedge means for locking the plate and socket to the transverse beam to enable support of the lower end of a ram or as a stop to prevent transverse movement of the beam.

9. The structure as defined in claim 8 wherein the plate engaged with the beam includes a transverse rib on the lower surface thereof for lockingly engaging the plate and socket with the transverse beam.

10. In a vehicle frame straightening apparatus utilizing a hydraulic ram and a flexible chain connected to a vehicle component to be straightened, that improvement comprising a base plate having means on the upper surface thereof for connection with the lower end of a hydraulic ram in order to support the ram in upwardly extending position, said base plate including a substantially planar lower surface adapted to be supported on a horizontally disposed supporting surface and transfer the reaction force from the ram to the supporting surface and means spaced from the means connecting the ram and base plate for precluding upward movement of the base plate in relation to the supporting surface by engagement with a downwardly facing surface on the supporting surface thereby securely retaining the base plate on the supporting surface while enabling adjustment of the base plate in relation to the supporting surface and orientation of the base plate in different positions in relation to the supporting surface, and a stand supported on the supporting surface, a crossbar attached to the stand and underlying the vehicle with means securing the crossbar to the vehicle, means on the stand engaging the crossbar and means detachably connecting the stand to the supporting surface.

11. The structure as defined in claim 10 wherein the supporting surface is the runway of a vehicle frame straightening machine, said means supporting the stand including a plate mounted on the top surface of the runway and including a reversely curved edge engaging and underlying the edge of the runway, a movable plate having a reversely curved flange engaging the opposite edge of the runway and slidably guided in relation to the plate engaging the top surface of the runway, clamp bolt means interconnecting the plates to securely and releasably lock the stand to the runway.

12. The structure as defined in claim 11 wherein said means securing the crossbar to the stand includes an upwardly opening socket having a removable cap enabling the crossbar to be inserted into the socket and retained therein, the bottom of said socket including a plurality of upwardly projecting pointed members for anchoring the crossbar to the stand, said means securing the crossbar to the vehicle including a sleeve slidably adjustably mounted on the crossbar, an upstanding clamp plate mounted rigidly on said sleeve, a movable clamp plate, bolt means urging said clamp plates towards each other to clampingly engage a vehicle component.

13. In a vehicle frame straightening apparatus utilizing a hydraulic ram and a flexible chain connected to a vehicle component to be straightened, that improvement comprising a base plate having means on the upper surface thereof for connection with the lower end of a hydraulic ram in order to support the ram in upwardly extending position, said base plate including a substantially planar lower surface adapted to be supported on a horizontally disposed supporting surface and transfer the reaction force from the ram to the supporting surface and means spaced from the means connecting the ram and base plate for precluding upward movement of the base plate in relation to the supporting surface by engagement with a downwardly facing surface on the supporting surface thereby securely retaining the base plate on the supporting surface while enabling adjustment of the base plate in relation to the supporting surface and orientation of the base plate in different positions in relation to the supporting surface, and a stretch beam related to the supporting surface, said supporting surface including a pair of runways of a vehicle frame straightening machine with transverse beams extending under the runways and adjustably and movably secured thereto, said stretch beam being secured to the transverse beams and having selectively attached thereto a base plate for connecting the ram and an anchor for connecting a chain.

14. In combination with a vehicle frame straightening machine having drive-on and drive-off runways laterally adjustably connected with transverse beams, a base plate adjustably but fixedly supported from a selected point on said runways and beams, a hydraulic ram having the lower end connected to the base plate and extending upwardly therefrom in inclined relation, a flexible tension member connected to the vehicle component to be straightened and extending over the upper end of the ram, means anchoring an end portion of the tension member to a selected point on said runways and beams to enable a vector force to be applied to the vehicle by the tension member when the ram is expanded, said base plate including mounting means enabling it to be longitudinally movable along the runways and beams with said mounting means depending into engagement with the runways and beams but not extending into contact with an underlying stationary support surface said base plate including a substantially planar bottom surface for engagement with the upper surface of a runway, said mounting means including a reversely curved edge portion on the plate depending and facing inwardly therefrom for hooking engagement on the side edge of the runway to enable longitudinal adjustment of the base plate on the runway, the pin means on the base plate spaced from the reversely curved edge for extending into longitudinally spaced holes in the runway to anchor the base plate in adjusted position, said means anchoring the outer end of the flexible tension member including a plate engaging the upper surface of a transverse beam and including a depending projection extending through and below the beam and provided with a transverse aperture receiving wedge means to secure the plate to the transverse beam, said tension member being a chain and the plate including a vertically oriented passageway having a vertical notch extending upwardly from the lower edge of one portion thereof for receiving a chain link forming part of the tension member with the remainder of the tension member extending upwardly and over the plate inwardly of the tension member to retain the chain link in the notch for securing the tension member thereto.

15. In combination with a vehicle frame straightening machine having drive-on and drive-of runways and transverse beams, stands adjustably mounted longitudinally on the runways with the upper end of the stands supporting tubular cross bars extending therebetween and under a vehicle positioned on the runways, clamp members mounted on the crossbars in adjusted position and clampingly engaged with portions of the vehicle to be straightened thereby anchoring the vehicle during the straightening process, each stand including a base having telescopic components with hook-shaped ends engaged with the side edges of the runway and a screw threaded member to clamp the telescopic members in secure adjusted position on the runway.

16. The combination as defined in claim 15 wherein each of the stands includes a sleeve at the upper end thereof adjustably receiving the crossbar, clamp members securing the crossbar in adjusted position in relation to the sleeve, said means on the crossbar clampingly engaging the vehicle including a sleeve slidable on the crossbar with longitudinally elongated clamp plates mounted thereon with the clamp plates including a plurality of clamp bolts extending therebetween and pins on one of the clamp plates to lockingly engage with a depending flange member on the vehicle.

* * * * *